US011458585B2

(12) United States Patent
Giese

(10) Patent No.: US 11,458,585 B2
(45) Date of Patent: Oct. 4, 2022

(54) GRINDING MACHINE FOR GRINDING A SURFACE OF AN OBJECT

(71) Applicant: Karl Heesemann Maschinenfabrik GmbH & Co. KG, Bad Oeynhausen (DE)

(72) Inventor: Christoph Giese, Herford (DE)

(73) Assignee: Karl Heesemann Maschinenfabrik GmbH & CO. KG, Bad Oeynhausen (DE)

( * ) Notice: Subject to any disclaimer, the term of this patent is extended or adjusted under 35 U.S.C. 154(b) by 397 days.

(21) Appl. No.: 15/979,943

(22) Filed: May 15, 2018

(65) Prior Publication Data

US 2018/0333823 A1 Nov. 22, 2018

(30) Foreign Application Priority Data

May 19, 2017 (DE) ..... 102017110950.1

(51) Int. Cl.
*B24B 29/00* (2006.01)
*B24B 27/00* (2006.01)
*B24B 7/06* (2006.01)

(52) U.S. Cl.
CPC ..... *B24B 29/005* (2013.01); *B24B 7/06* (2013.01); *B24B 27/0023* (2013.01)

(58) Field of Classification Search
CPC ..... B24B 29/005; B24B 7/06; B24B 7/0023; B24B 27/00; B24B 41/04; B24B 47/12
USPC ..... 451/259
See application file for complete search history.

(56) References Cited

U.S. PATENT DOCUMENTS

| | | | | |
|---|---|---|---|---|
| 2,948,087 | A | 8/1960 | Caton | |
| 6,949,005 | B1 * | 9/2005 | Larsen | B24B 5/047 451/259 |
| 9,597,766 | B2 * | 3/2017 | Hayashi | B24B 27/0069 |
| 2008/0280545 | A1 * | 11/2008 | Weber | B24B 41/047 451/259 |
| 2017/0234365 | A1 * | 8/2017 | Oshida | B24B 41/04 451/259 |

FOREIGN PATENT DOCUMENTS

| | | | |
|---|---|---|---|
| CN | 101069064 | A | 11/2007 |
| CN | 104968471 | A | 10/2015 |
| DE | 20 2007 010 059 | U1 | 11/2007 |
| TW | 201431645 | A | 8/2014 |

* cited by examiner

*Primary Examiner* — Monica S Carter
*Assistant Examiner* — Alberto Saenz
(74) *Attorney, Agent, or Firm* — WC&F IP

(57) ABSTRACT

A grinding machine for grinding a surface of an object is described which has a plurality of grinding brushes which are rotatably mounted about a brush axis of rotation, at least one brush carrier on which at least one of the grinding brushes is mounted and which is rotatably mounted about a carrier axis of rotation, and a conveying device for conveying the object at a feed speed through the grinding machine. The grinding machine has an input device and an output device. A brush rotational speed about the brush axis of rotation and/or a carrier rotational speed about the carrier axis of rotation and/or the feed speed is/are adjustable by the input device, and an expected grinding result can be output by the output device.

18 Claims, 7 Drawing Sheets

GRINDING MACHINE FOR GRINDING A SURFACE OF AN OBJECT

FIELD OF THE INVENTION

The invention relates to a grinding machine for grinding the surface of an object, the grinding machine having a plurality of grinding brushes which are rotatably mounted about a brush axis of rotation, at least one brush carrier, on which at least one of the grinding brushes is mounted and which is rotatably mounted about a carrier axis of rotation, and a conveying device for conveying the object through the grinding machine at a feed speed. Such a grinding machine is known, for example from DE 10 2007 022 194 B4. Such grinding machines are used for grinding surfaces of objects, wherein the desired grinding result can be chosen to be very different. If the workpiece to be processed is processed further after the grinding, for example, for example painted, it is advantageous to achieve the most uniform grinding pattern possible, so that as far as possible no grinding traces, grooves, scores, or other depressions remain on the surface. If, on the other hand, the surface to be ground is not to be processed further, for example, it may be entirely desirable to leave behind specific types of grinding traces on the surface in order to achieve a decorative effect. To this end, it is known, for example from DE 10 2011 116 842 A1, to use a grinding machine which is constructed with a transverse grinding belt in such a way that the grinding direction is not necessarily at right angles to the feed direction, instead the angle enclosed between the two directions is adjustable. In addition, active regions of the grinding belt may alternate with passive regions of the grinding belt.

BACKGROUND

In grinding machines from the prior art, as a rule the distance between the individual grinding brushes on the one hand and the conveying direction on the other hand is adjustable. Therefore, it is possible to react to workpieces of different thicknesses and, in addition, to adjust a contact pressure or grinding pressure of the individual grinding brushes on the surface to be ground. The prior art discloses grinding machines in which this adjustment is carried out automatically under sensor control. If, in each workpiece to be ground, the same grinding effect is intended to be achieved, this is entirely achievable with the grinding machines known from the prior art. However, a changeover, for example from a most uniform grinding result possible to a specific grinding pattern, is not possible or possible only with great effort. The invention is therefore based on the object of developing a grinding machine further in such a way that as many different grinding results as possible can be achieved and the appropriate adjustments can be performed as simply as possible.

SUMMARY

The invention achieves the set object by means of a grinding machine according to the pre-characterizing clause of claim 1, which is distinguished by the fact that the grinding machine has an input device and an output device, wherein a brush rotational speed about the brush axis of rotation and/or a carrier rotational speed about the carrier axis of rotation and/or the feed speed is/are adjustable by the input device, and an expected grinding result can be output by the output device.

As compared with grinding machines from the prior art, further parameters are consequently adjustable in a grinding machine according to the invention. This is true in particular if a plurality of the parameters cited in the claim are adjustable. Both the brush rotational speed and the carrier rotational speed and the feed speed have an independent influence on the grinding result to be expected. Since, in particular in the adjustment of ail the said parameters, a multi-dimensional parameter space is involved, even for experienced technicians the individual grinding results are unpredictable or are difficult to predict. This is true in particular when, for example, the brush rotational speed and the carrier rotational speed are adjustable independently of each other. This, in combination with an adjustable feed speed, offers a multiplicity of extremely different movement patterns of the individual brushes relative to the surface to be ground. Therefore, the machine additionally has an output device, on which an expected grinding result, which of course depends on the brush rotational speed, the carrier rotational speed and the feed speed, can be output.

The output device is preferably a display device, for example a display, particularly preferably an LCD or LED display, on which the grinding result to be expected is displayed. This can be carried out in a black and white display or particularly preferably in a color display, wherein a grinding depth or an applied grinding pressure can preferably be encoded by the color. The display can be presented two-dimensionally or three-dimensionally.

Following the adjustment of the respective parameters on the output device, the operator of the grinding machine can consequently see how the expected grinding result appears. If appropriate, further parameters, for example a contact pressure of the brushes, different brush rotational speeds for different brushes, different carrier rotational speeds for different carriers, the surface condition of the surface to be ground and other parameters, can be entered and included in the expected grinding result, which is output via the output device.

In a preferred refinement, the grinding machine has an electric controller, in particular a microprocessor, which is configured to calculate the expected grinding result by means of the set parameters. In this case, an algorithm which has been stored in an electronic data memory is executed on the electronic data processing device, Le. the electronic controller. The set parameters are introduced into the algorithm and processed further in the latter. Thus, for example, a movement pattern of the individual brushes relative to the surface to be ground is determined. In addition, a surface condition, in particular a surface material of the surface to be ground, can also be included in the execution of the algorithm, so that, for example, a grinding depth or different grinding pressure is also included in the calculation and incorporated in the displayed grinding result to be expected.

Advantageously, the grinding machine has a plurality of brush carriers, for which various carrier rotation speeds are adjustable by the input device. Additionally or alternatively, the grinding machine has a plurality of grinding brushes, for which various brush rotational speeds are adjustable by the input device. For some embodiments, it is entirely sufficient to provide identical carrier rotational speeds adjustably for some of the brush carriers and/or identical rotational speeds adjustably for some of the grinding brushes. In this case, the different brush carriers and/or the different brushes can, if appropriate, be adjustable only jointly to a respective rotational speed.

Preferably, the brush carriers are rotatable in the same direction. This means that they can all be rotated in the same direction, that is to say with the same direction of rotation, for example clockwise.

Advantageously, the brush carriers are arranged to be offset in the feed direction. As a result, the circles of action of the individual brush carriers and the grinding brushes located thereon can quite possibly overlap along a direction transverse to the feed direction. This prevents there being regions of the surface to be ground which cannot be processed or are processed too highly by a grinding brush. In a particularly preferred refinement, the distance of the individual brush carriers in the feed direction andfor transverse to the feed direction is also adjustable. In addition, as a result the grinding result can be influenced and thus the versatility of the grinding results to be achieved can be increased.

Preferably, the brush carriers are arranged such that the circles of action of the grinding brushes overlap. Here, a circle of action of a brush is understood to mean in particular the region over which a grinding brush sweeps when the brush carrier on which the grinding brush is located executes a revolution. The circle of action of a brush carrier is the sum of the circles of action of the grinding brushes which are arranged on the respective brush carrier.

Circles of action can overlap directly. This happens when there are points over which two different grinding brushes sweep, even if the surface is not moved but only the brush carriers are moved. Circles of action can also overlap indirectly. Here, points on the surface to be ground are swept over by multiple grinding brushes which are arranged on different brush carriers only when the workpiece or object is moved along the feed direction. This type of overlap can be achieved particularly simply when brush carriers are arranged to be offset in the feed direction.

Advantageously, at least one brush carrier is mounted eccentrically. This means that the carrier axis of rotation does not run through the center of the brush carrier. As a result, the different grinding brushes which are located on this brush carrier are at a different distance from the carrier axis of rotation and thus, during the rotation of the brush carrier, although they move on circular paths, these are possibly of different sizes for the different grinding brushes however.

In a preferred refinement, the level of eccentricity is adjustable by the input device. The level of eccentricity is in this case for example a measure of the distance of the carrier axis of rotation from the center of the brush carrier. Here, too, it may be advantageous to adjustably configure different levels of eccentricity for different brush carriers.

In a preferred refinement, the input device has an interface to a data link, in particular a Bluetooth interface, a USB interface, an Internet application or a wire-free interface, for example a radio or WLAN interface. In this way, preset parameter sets, for example, can be transmitted by a customer and made available to the grinding machine or the electric data-processing device. In addition, the grinding result to be expected can also be sent via the output device to another location, for example a customer, via the same data link. It is thus not necessary to be at the location of the grinding machine in order to operate or to monitor the same.

Preferably, the input device has an operating element by means of which the parameters are adjustable manually. This can be, for example, a keyboard or a keyboard depicted on a display. Of course, it is also possible, for example, to configure an external data-processing device, for example a computer, laptop, a smartphone or a tablet, as a corresponding operating element. In this case, it is advantageous to install appropriate software on the data-processing device. This can be, for example in the case of a smartphone or a tablet, an App, which for example can be downloaded from the Internet and permits operation of the grinding machine or at least the adjustment of the individual parameters.

Preferably, the grinding machine has an electronic data memory, in which set parameters can be stored. Here, it is sufficient if the grinding machine has access to a corresponding electronic data memory. Within the context of the present invention, the electronic data memory does not have to be part of the grinding machine itself. In such a data memory, the set parameter sets can be stored and used again at a later time.

The grinding machine preferably has a recording device, by means of which an achieved grinding result can be recorded. This recording device is, for example, a camera and is preferably aimed at the ground surface. It is consequently arranged in the feed direction after the actual grinding mechanism, that is to say the grinding brushes and brush carriers. The recording device is preferably connected to an electronic data-processing device. The recorded data, for example recorded images, is transmitted to the data-processing device and further processed therein. The data-processing device is, for example, configured to compare the data from the achieved grinding result with the expected grinding result. If a deviation determined in the process is greater than a predetermined tolerance value, the electronic data-processing device can change at least one parameter, for example the brush rotational speed, the carrier rotational speed, a contact pressure and/or the feed speed, and thus iteratively adapt the achieved grinding result to the expected grinding result. The result of the comparison can therefore be used as a feedforward control parameter or feedback control parameter.

BRIEF DESCRIPTION OF THE DRAWINGS

With the aid of the appended drawings, some exemplary embodiments of the present invention will be explained in more detail below. In the drawing.

DETAILED DESCRIPTION

Figure 1:
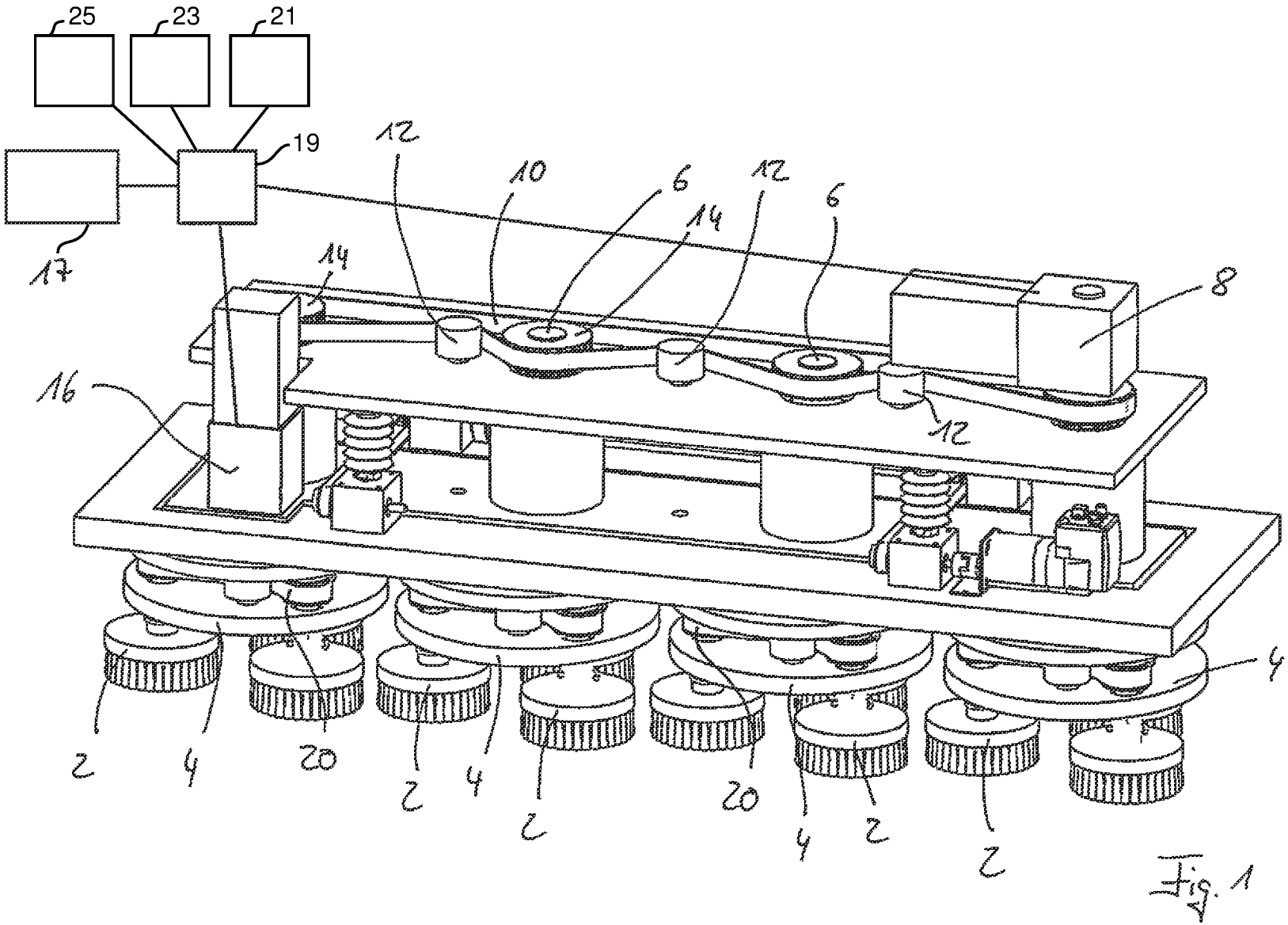
FIG. 1—shows the schematic three-dimensional view of part of a grinding machine according to a first exemplary embodiment of the present invention, FIG. 2—shows the schematic illustration of brush carriers and grinding brushes, FIG. 3—shows the schematic illustrations of circles of action, FIG. 4—shows the schematic illustration of a drive for a grinding machine, FIG. 5—shows the schematic illustration of circles of action according to another exemplary embodiment of the present invention, FIG. 6—shows a further view of circles of action according to a further exemplary embodiment of the present invention, and FIG. 7—shows a schematic illustration of two different control modes.

FIG. 1 shows, schematically, part of a grinding machine according to a first exemplary embodiment of the present invention. It has a plurality grinding brushes 2, of which, in the exemplary embodiment shown, respectively three are arranged on a brush carrier 4. Each of the brush carriers 4 is rotatably mounted about a carrier axis of rotation 6. For this purpose, there is a carrier drive 8, for example in the form of an electric motor, by which, via a first transmission belt 10, the carrier axes of rotation 6 and therefore the brush carriers 4 can be set rotating. Deflection rollers 12 ensure that the carrier gears 14 surrounding the respective carrier axes of rotation 6 are wrapped around by the first transmission belt 10 with sufficient tension.

The grinding machine according to FIG. 1 additionally has a brush drive 16, which can likewise be present in the form of an electric motor. The individual brushes 2 are driven by the same via a second transmission belt 18, not shown. For this purpose, in the exemplary embodiment shown each brush carrier 4 has a third transmission belt 20, by means of which the movement transmitted via the second transmission belt 18 is transmitted to the individual brushes 2 of respectively one brush carrier 4.

FIG. 1 additionally shows an output device 17 which, for example, is a monitor. An input device 21, for example in the form of a keyboard, should also preferably be included, in order that the desired values of the parameters to be adjusted can be entered. The output device 17 is coupled to a schematically illustrated electronic data-processing device 19, which is connected to the brush drive 16 and the carrier drive 8.

Figure 2:
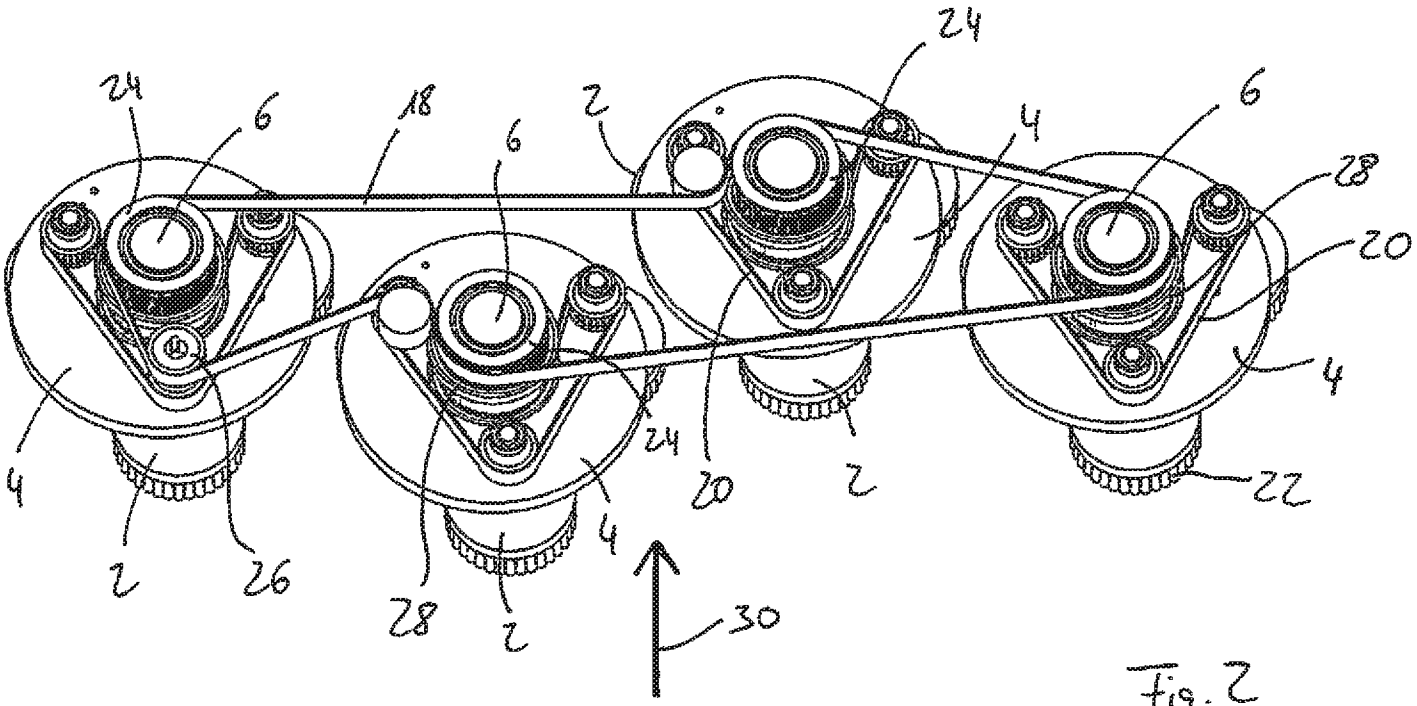

FIG. 2 shows the schematic illustration of a similar embodiment of the grinding machine. As in FIG. 1, it is possible to see four brush carriers 4, on which respectively three grinding brushes 2 are arranged. The individual grinding brushes 2 in the present case are formed as pot-shaped brushes, so that the bristles 22 of the individual grinding brushes 2 are located only in the edge region thereof. Of course, disk brushes or other brush shapes are also conceivable.

It is additionally possible to see the carrier axes of rotation 6. They are surrounded by respectively one first brush gear 24, in which they can rotate freely. The first brush gears 24 are connected to one another via the second transmission belt 18. Via a drive gear 26, a torque applied by the brush drive 16, not illustrated in FIG. 2, is transferred to the second transmission belt 18 and therefore to the first brush gears 24. These are coupled to a second brush gear 28, which engages in the third transmission belt 20 and transmits the movement to the actual grinding brushes 20. Since the grinding brushes 2 are driven by the brush drive 16 and the brush carriers 4 are driven by the carrier drive 8, the respective rotational speeds can be adjusted independently of one another. In the exemplary embodiment shown, however, it is not possible to set different carrier rotational speeds for different brush carriers 4 or different brush rotational speeds for different grinding brushes 2.

The four brush carriers 4 in FIGS. 1 and 2 are arranged in a transverse direction. The feed direction extends at right angles thereto, in the exemplary embodiments shown therefore from bottom to top or from top to bottom. It is possible to see in FIG. 2 that the individual brush carriers 4 are arranged to be offset in this feed direction, which is indicated by the arrow 30.

Figure 3:
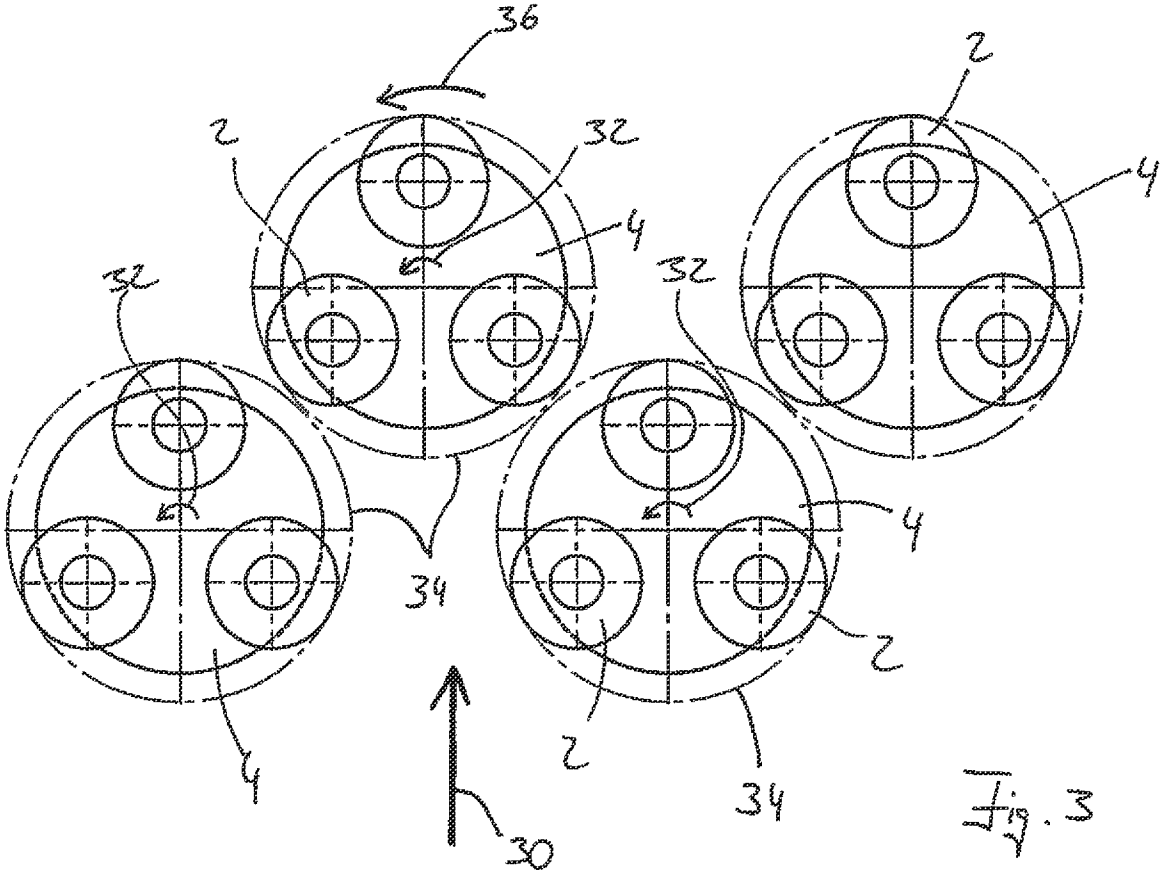

The individual circles of action of the brushes are illustrated in FIG. 3. It is possible to see, schematically, the brush carriers 4, on which respectively three grinding brushes 2 are located. They project beyond the circumference of the brush carrier 4. if, then, the brush carriers 4 are moved along the brush direction of rotation illustrated by the arrow 32, the grinding brushes 2 are co-rotated and the outermost edge of the grinding brushes 2 describes the circle of action 34 illustrated in a dash-dotted line. At the same time, the individual grinding brushes 2 are moved in the brush direction of rotation illustrated by the arrow 36.

Since here, too, the individual brush carriers 4 are arranged to be offset in the feed direction, which is again illustrated by the arrow 30, there is no point on a surface of a workpiece which is not processed by a grinding brush 2, although the individual circles of action 34 do not overlap one another.

Figure 4:
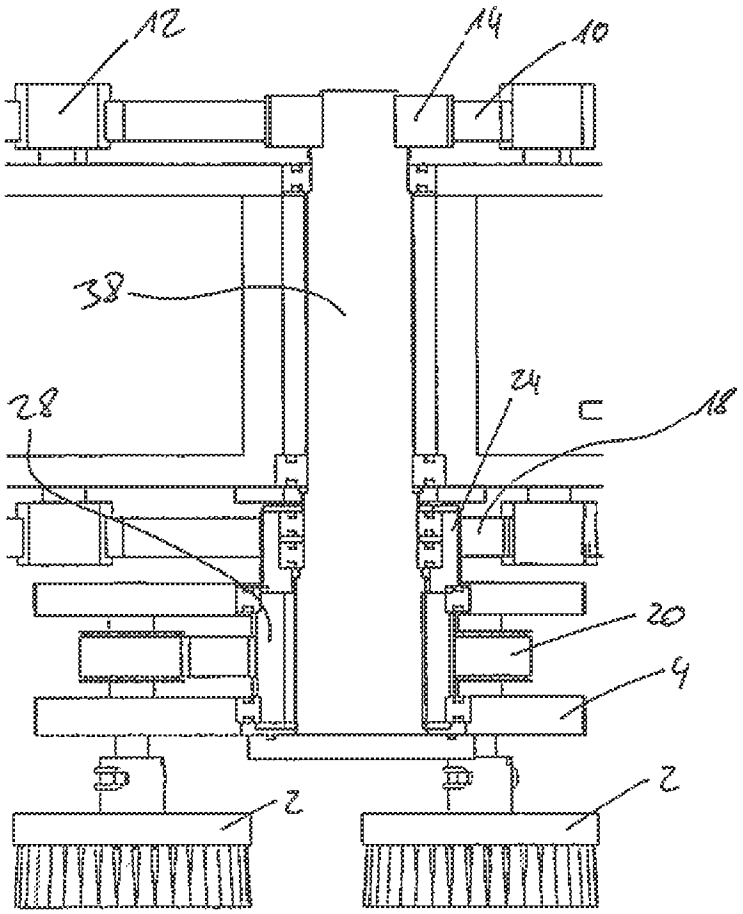

FIG. 4 shows, schematically, the structure of the different drives. It is possible to see two grinding brushes 2, which are arranged on the brush carrier 4. The latter is driven via a drive shaft 38, on the other end of which the carrier gear 14 is located, which engages with the first transmission belt 10. It is additionally possible to see one of the deflection rollers 12 already illustrated in FIG. 1.

Arranged around the drive shaft 38 is the first brush gear 24, which engages in the second transmission belt 18. It extends downward in FIG. 2 and is connected to the second brush gear 28, which engages in the third transmission belt 20 and transmits the movement to the actual grinding brushes 2.

Figure 5:
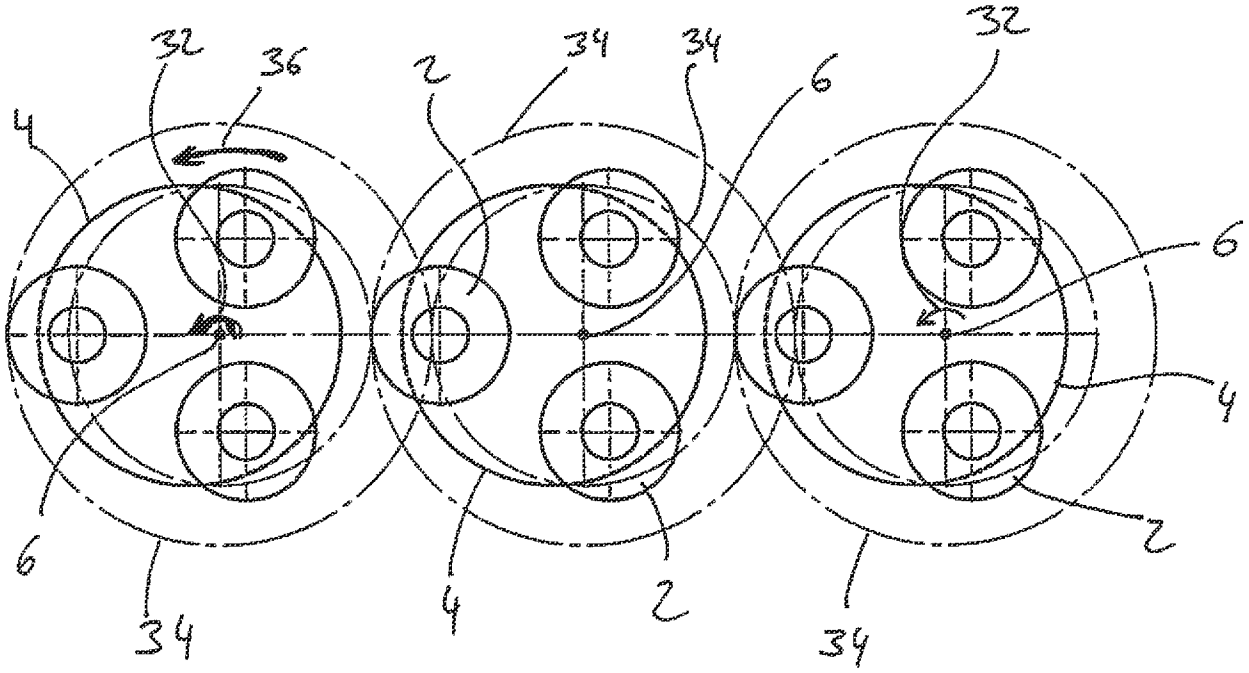

FIG. 5 shows an illustration similar to that of FIG. 3 It is possible to see three brush carriers 4, on which respectively three grinding brushes 2 are arranged. The latter also project beyond the outer circumference of the brush carrier 4 and are rotated along the brush direction of rotation illustrated by the arrow 36. Differing from the exemplary embodiment shown in FIG. 3, the individual brush carriers 4 are, however, arranged eccentrically around the carrier axis of rotation 6. The individual brush carriers are rotated about this carrier axis of rotation 6 in the direction illustrated by the arrow 32. As a result, each of the grinding brushes 2 describes a circular path around the carrier axis of rotation 6 but the individual distances of the grinding brushes from the carrier axis of rotation 6 are of different sizes, so that the result is different circles of action 34 for different grinding brushes 2. Because of the eccentricity of the suspension of the brush carriers 4 about the carrier axis of rotation 6, the individual circles of action 34 overlap without it being possible for collisions to occur between the individual brush carriers 4 or the grinding brushes 2. Therefore, in the refinement shown in FIG. 5, it is not necessary to arrange the brush carriers 4 to be offset along the feed direction.

Figure 6:
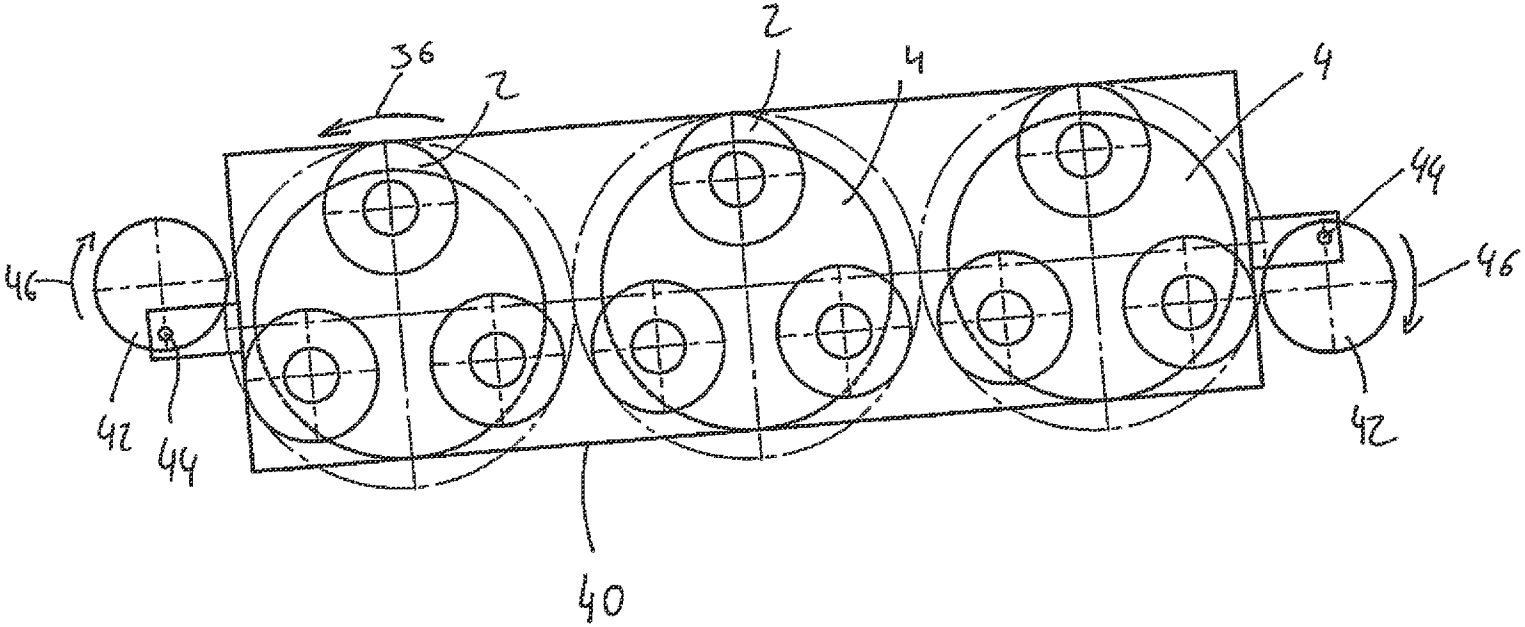

FIG. 6 shows a further refinement of the different arrangements. It is possible to see three brush carriers 4, on which there are arranged respectively three grinding brushes 2, which are rotated about the brush direction of rotation illustrated by the arrow 36. The individual brush carriers 4 are not arranged to be offset relative to one another but are positioned on a common carrier beam 40. The latter is arranged at its two ends on a rotational disk 42 each, the fixing 44 being carried out eccentrically. If the rotational disks 42 are set moving along the direction of rotation 46, a pivoting or tumbling movement of the carrier beam 40 occurs. In a preferred refinement, the rotational speed at which the rotational disks 42 rotate can also be adjusted.

Figure 7:
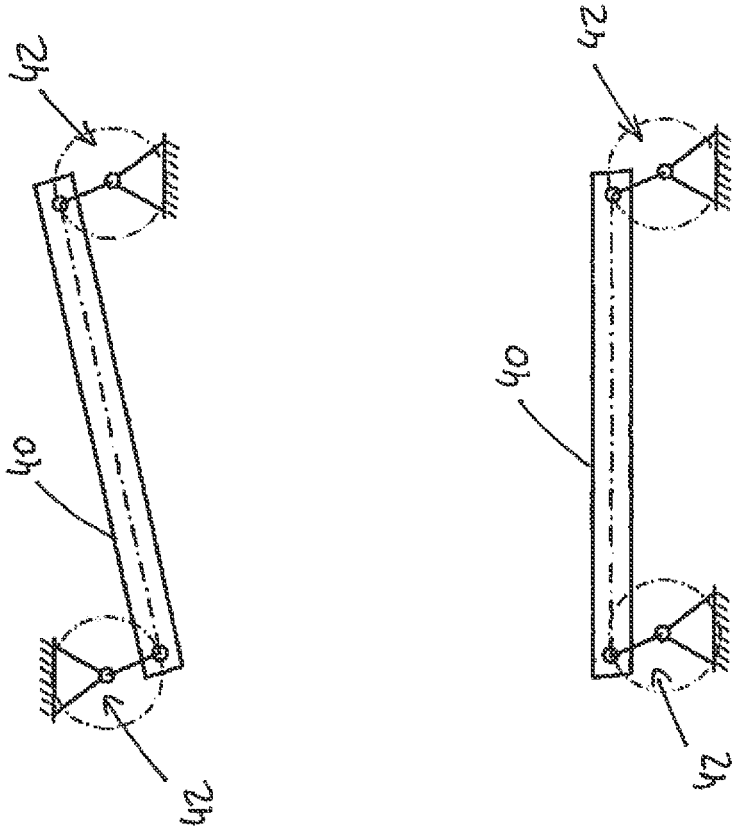

FIG. 7 shows that, in principle, two different rotation modes can be chosen. In the lower example of FIG. 7, the two rotational disks 42, which are illustrated only schematically in FIG. 7, are rotated in the same direction. In this way, the movement of the brush carriers 4, not illustrated, and of the grinding brushes 2 has superimposed on it an additional rotational movement, since the carrier beam 40 is moved without changing its orientation. In the upper part of FIG. 7, on the other hand, the two rotational disks 42 rotate in different directions of rotation. As a result, a tumbling movement of the carrier beam 40 occurs, which is superimposed on the movement of the grinding brushes 2 and the brush carriers 4. Advantageously, the direction of rotation of at least one of the two rotational disks can consequently also be adjusted, in order in this way to be able to achieve further grinding patterns.

The grinding machine preferably has a recording device 23, by means of which an achieved grinding result can be recorded. This recording device 23 is, for example, a camera and is preferably aimed at the ground surface. It is consequently arranged in the feed direction after the actual grinding mechanism, that is to say the grinding brushes and brush carriers. The recording device 23 is preferably connected to an electronic data-processing device 19. The recorded data, for example recorded images, is transmitted to the data-processing device 19 and further processed therein.

Preferably, the grinding machine has an electronic data memory 25, in which set parameters can be stored. Here, it is sufficient if the grinding machine has access to a corresponding electronic data memory 25. Within the context of the present invention, the electronic data memory 25 does not have to be part of the grinding machine itself. In such a data memory, the set parameter sets can be stored and used again at a later time. In a preferred refinement, the grinding machine has an electric controller 19, in particular a microprocessor, which is configured to calculate the expected grinding result by means of the set parameters. In this case, an algorithm which has been stored in an electronic data memory 25 is executed on the electronic data processing device 19, i.e. the electronic controller 19. The set parameters are introduced into the algorithm and processed further in the latter.

LIST OF DESIGNATIONS

2 Grinding brush
4 Brush carrier
6 Carrier axis of rotation
8 Carrier drive
10 First transmission belt
12 Deflection roller
14 Carrier gear
16 Brush drive
17 Output device
18 Second transmission belt
19 Data-processing device
20 Third transmission belt
22 Bristles
24 First brush gear
26 Drive gear
28 Second brush gear
30 Arrow
32 Arrow
34 Circle of action
36 Arrow
38 Drive shaft
40 Carrier beam
42 Rotational disk
44 Fixing
46 Direction of rotation

The invention claimed is:

1. A grinding machine for grinding a surface of an object, comprising:

a plurality of grinding brushes which are rotatably mounted about a brush axis of rotation, at least one brush carrier on which at least one of the plurality of grinding brushes is mounted, wherein the at least one brush carrier is rotatably mounted about a carrier axis of rotation, an input device and an output device, wherein one or more set parameters are adjustable by the input device, the set parameters comprising at least one of a brush rotational speed about the brush axis of rotation, a carrier rotational speed about the carrier axis of rotation, and a feed speed, and an electronic controller configured to calculate an expected grinding result of grinding the surface of the object as a result of using the set parameters, wherein the expected grinding result is output by the output device, wherein the output device has a display device on which the expected grinding result is displayable two-dimensionally or three-dimensionally.

2. The grinding machine according to claim 1, wherein the at least one brush carrier includes a plurality of brush carriers, wherein various carrier speeds of rotation are adjustable by the input device for each of the plurality of brush carriers.

3. The grinding machine according to claim 2, wherein each of the plurality of brush carriers are arranged offset in a feed direction.

4. The grinding machine according to claim 2, wherein each of the brush carriers are arranged such that circles of action of the plurality of grinding brushes overlap.

5. The grinding machine according to claim 2, wherein each of the plurality of brush carriers are rotatable in a same direction.

6. The grinding machine according to claim 1, wherein the at least one brush carrier is mounted eccentrically.

7. The grinding machine according to claim 6, wherein a level of eccentricity is adjustable by the input device.

8. The grinding machine according to claim 1, wherein the input device has an interface to a data link.

9. The grinding machine according to claim 8, wherein the interface is selected from the group consisting of a Bluetooth interface, a USB interface, an Internet connection, and a wire-free interface.

10. The grinding machine according to claim 8, wherein the interface is a wire-free interface selected from the group consisting of a radio or WLAN interface.

11. The grinding machine according to claim 1, wherein the input device is configured for manual adjustment of parameters.

12. The grinding machine according to claim 1, further comprising an electronic data memory which stores the set parameters.

13. The grinding machine according to claim 1, further comprising a recording device for recording an achieved grinding result on the surface of the object.

14. The grinding machine according to claim 13, wherein the recording device is a camera.

15. The grinding machine according to claim 13, wherein the electronic controller is further configured to compare the recorded achieved grinding result with the expected grinding result, wherein a result of this comparison is received by the input device as a feedforward control parameter or feedback control parameter.

16. The grinding machine according to claim 1, wherein the electronic controller is a microprocessor.

17. The grinding machine according to claim 1, wherein the expected grinding result calculated by the electronic controller and output by the output device includes one or more of a movement pattern of individual brushes from the plurality of grinding brushes relative to a surface to be ground, a grinding depth, and a grinding pressure.

18. The grinding machine according to claim 1, wherein the expected grinding result includes a grinding depth.

* * * * *